United States Patent [19]

Batts

[11] Patent Number: 4,917,370

[45] Date of Patent: Apr. 17, 1990

[54] SHEET LAUNCHER FOR ROLL FORMING MACHINE

[75] Inventor: Graham W. Batts, Dunedin, New Zealand

[73] Assignee: White Consolidated Industries, Inc., Cleveland, Ohio

[21] Appl. No.: 90,449

[22] Filed: Aug. 28, 1987

[51] Int. Cl.[4] ..... B65H 9/14

[52] U.S. Cl. ..... 271/229; 271/238; 271/240; 271/253; 271/266; 271/273; 72/251

[58] Field of Search ..... 271/229, 234, 236, 238, 271/240, 239, 253, 266, 272, 273, 275, 277, 226, 265; 72/251, 250

[56] References Cited

U.S. PATENT DOCUMENTS

| | | | |
|---|---|---|---|
| 1,848,856 | 3/1932 | Wagner et al. | 271/240 |
| 2,632,641 | 3/1953 | Rice | 271/273 X |
| 2,805,856 | 7/1968 | Stuchbery . | |
| 3,416,790 | 12/1968 | Davis | 271/273 |
| 3,533,619 | 7/1968 | Guenther et al. . | |
| 4,009,878 | 3/1977 | Scheck | 271/272 |
| 4,090,703 | 5/1978 | Straube | 271/273 X |
| 4,472,864 | 9/1984 | Cunningham et al. | 271/275 X |
| 4,607,837 | 8/1986 | Pierce | 271/273 |

*Primary Examiner*—H. Grant Skaggs
*Assistant Examiner*—David H. Bollinger
*Attorney, Agent, or Firm*—Pearne, Gordon, McCoy & Granger

[57] ABSTRACT

A launcher for launching pieces of sheet metal into a roll former is disclosed. The launcher includes laterally spaced conveyor belts having parallel upper reaches which support the piece of sheet metal and transport it to a launch position. While located in the launch position, opposed pushers engage opposite edges of the sheet and move it laterally into a predetermined lateral location in which it is centered and aligned with the roll former. Thereafter, longitudinally spaced gripper rolls engage and grip the opposite sides of the sheet at longitudinally spaced locations. The gripper rolls operate to feed the sheet and maintain gripping thereof until substantially the entire sheet enters the roll former. Therefore, proper alignment is maintained and uniform roll forming is produced. The pushers along one side of the sheet move to a fixed position to precisely locate the adjacent edge of the sheet. The pushers along the opposite side are spring-loaded so that proper positioning is achieved without damaging the edges of the sheet. Sensors are provided to determine if cutouts preformed in the sheet are properly located.

9 Claims, 5 Drawing Sheets

SHEET LAUNCHER FOR ROLL FORMING MACHINE

BACKGROUND OF THE INVENTION

This invention relates to generally to sheet feeders, and more particularly to a method and apparatus for feeding individual pieces of sheet metal into roll formers and the like.

Prior Art

In the manufacture of applicances such as refrigerators, freezers, and the like, it is desirable to produce shells and liners from pieces of sheet metal which are formed along their edges with seams and flanges so that they can be assembled with other appropriately shaped panels or pieces of sheet metal to provide a shell or liner assembly for the appliance. Such sheets, in many cases, are quite large, and often are quite long, e.g., the sides of a chest freezer shelf may be formed of a single piece of metal which is long enough to extend entirely around the freezer and provide all of the side walls thereof.

When it is necessary to form flanges or seams along the longitudinal edges of the sheet, efficiencies are achieved when the sheets are edge-formed in a roll former apparatus.

In order to accurately produce the required edge froms along the entire length of the sheet, it is necessary to very accurately position the sheet with respect to the roll former and to feed the sheet into the roll former in a very accurate manner. If the sheet is not accurately aligned with the roll former as it enters the rolls, the edges of the sheet will run-out and the shape produced along the edges of the sheet vary greatly from one end to the other. Further, if the sheets are not accurately centered with respect to the centerline of the roll former, the size and the form produced along one edge will be too large or too full, and the form produced along the opposite edge will be too small or unfilled.

In the past, it has been the practice in many instances to clamp the sheet on a shuttle carriage which moves the sheet into the roll former and then moves back to repeat the cycle with a subsequent sheet. Such apparatus requires that the carriage be returned and reloaded, and is relatively expensive and complex. An example, of such systems is described in U.S. Pat. No. 3,533,619.

It is also known to provide belt and roller systems for feeding sheets and webs in or to processing equipment. Examples of such systems are illustrated in U. S. Pat. Nos. 2,805,856; 4,009,878; and 4,472,854.

SUMMARY OF THE INVENTION

The present invention provides a novel and improved conveyor and launch apparatus for accurately positioning and feeding sheets into a roll former and the like. The illustrated embodiment is particularly suited for use in the production of liners or shells for large appliances, such as freezers, refrigerators, and the like. Such apparatus is capable of accurately feeding large pieces of prepainted, prepunched, and prenotched sheet metal without causing any damage to the finish thereof. An example of such appliance is illustrated in the copending application Ser. No. 80,750, filed July 31, 1987, now U.S. Pat. No. 4,826,040 and assigned to the assignee of this invention. Such application is incorporated herein by reference.

In accordance with this invention, large, rectangular sheets are conveyed to a launching position where they are laterally and longitudinally aligned with the subsequent processing equipment. In this instance, the subsequent processing equipment is a roll former which operates to produce lengthwise flanges and seams along the longitudinal edges of the sheets. Once these sheets are accurately positioned at the launch station, the sheets are gripped between two longitudinally spaced pairs of rollers. These rollers operate to feed the forward end of the sheet into the roll former and to maintain accurate alignment and accurate lateral positioning during such feeding operation.

After the forward end of the sheet has entered the roll former, the rollers continue to guide and position the sheet until substantially the entire sheet has progressed into the roll former. In fact, one pair of rollers maintains guiding engagement with a sheet until the rearward end of the sheet is about to enter the roll former. Consequently, the tendency of the sheet to run-out or experience side drift during the forming operation is virtually eliminated. Therefore, the shapes produced in the roll former are uniformly formed and positioned along the entire sheet, so that it is not necessary to perform subsequent trimming operations or the like.

The apparatus that positions the sheet in the launch position includes opposed pushers which engage the opposite longitudinal edges of the sheet at longitudinally spaced positions therealong. The pushers along one edge of the sheet move to a predetermined lateral position, and therefore locate the associated edge at an exact location and in exact alignment with the roll former. The opposite pushers include a resilient spring system which accommodates dimensional variations between the successive sheets that results from manufacturing tolerances. Such spring system ensures that the opposite edge of the sheet reliably positions against the fixed position pushers even when the sheet is at a minimum dimension within the dimensional tolerance range, and does not result in damage to the adjacent edge of the sheet when the sheets are at the maximum dimensions within the tolerance range.

These and other aspects of this invention are illustrated in the accompanying drawings and are more fully described in the following specification.

DETAILED DESCRIPTION OF THE DRAWINGS

Figure 1:
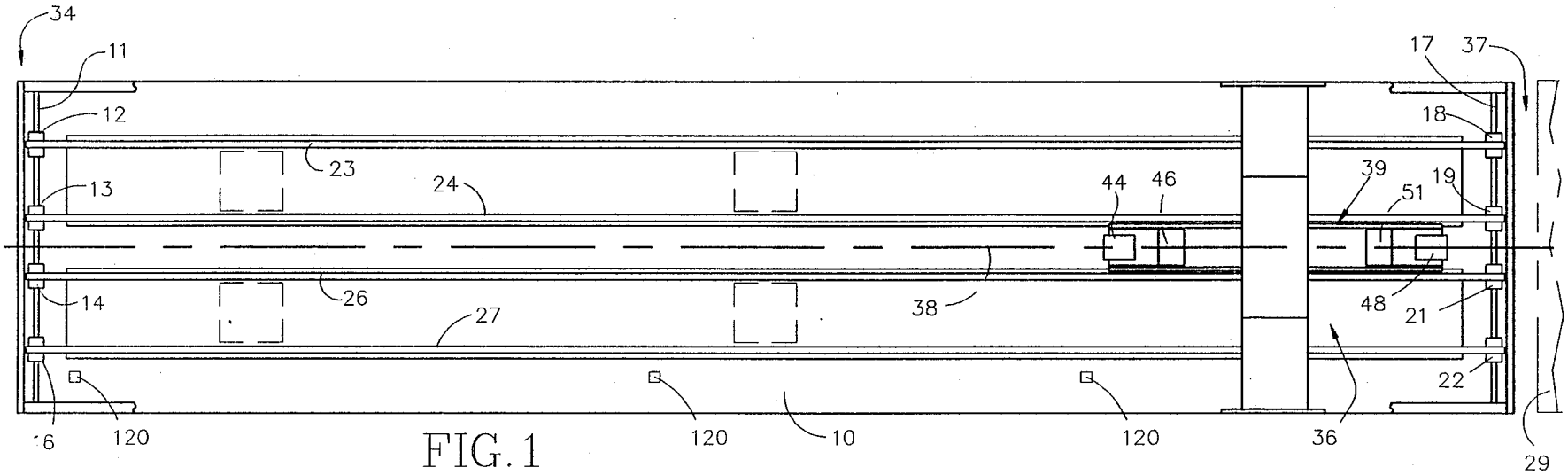
FIG. 1 is a plan view, schematically illustrating the conveyor and launching apparatus incorporating the present invention, with the sheet guide and pushers not illustrated to provide a clear illustration of the basic structure.
Figure 2:
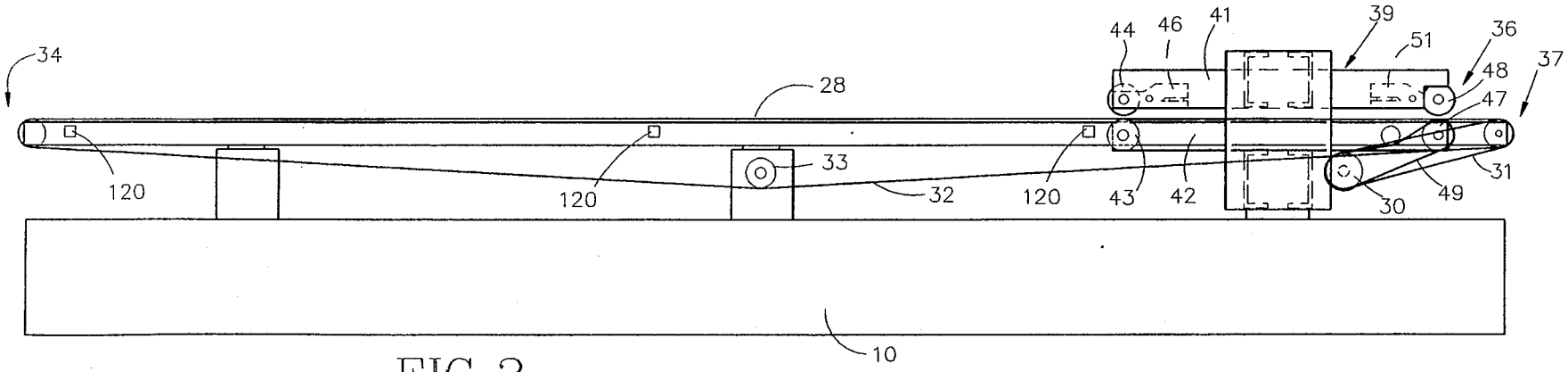
FIG. 2 is a side view of the conveyor and launching apparatus illustrated in FIG. 1.

FIGS. 1 and 2 illustrate the basic structure of a sheet launcher system in accordance with the present invention. The launcher includes a frame 10 which supports the operative components of the machine. Journaled on the frame 10 at one end thereof is a first cross shaft 11 on which four similar pulleys 12, 13, 14, and 16 are journaled. A second cross shaft 17 is journaled on the frame 10 at the opposite end thereof and also supports four similar drive pulleys 18, 19, 21, and 22.

Four laterally spaced and parallel belts 23, 24, 26, and 27 extend the length of the machine and with each belt extending around an associated pulley on the two cross shafts 11 and 17. These belts each provide an upper reach 28 which extends horizontally along the machine and provides laterally spaced supports for pieces of sheet metal which move along the machine to the launching position and subsequently into a roll former schematically illustrated at 29.

The cross shaft 17 is powered by a belt 31 driven by a motor 30. The belts 23, 24, 26, and 27 operate to support and move a piece of sheet metal from the left or entrance end 34 of the machine (as illustrated in the drawings) to a launch position 36 at the right or exit end 37 of the machine, as illustrated in the drawings. The upper reach 28 of each belt 23, 24, 26, and 27 is supported at regular intervals along its length by rollers 35, illustrated in FIG. 7, so that the upper reach 28 of each belt is maintained straight and cooperates with the other reaches 28 to provide a planar support for the pieces of sheet metal being conveyed to the launch position 36. The lower reaches 32 of the belts 23, 24, 26, and 27 each pass under an associated tensioning pulley 33.

The belts 23, 24, 26, and 27 cooperate to convey pieces of sheet metal from the entrance end 34 of the machine along the length of the machine to a launch position 36 adjacent to the exit end 37 of the machine. The roll former 29 is positioned in alignment with the longitudinal centerline 38 of the machine and substantially adjacent to the exit end 37 thereof.

Figure 4:
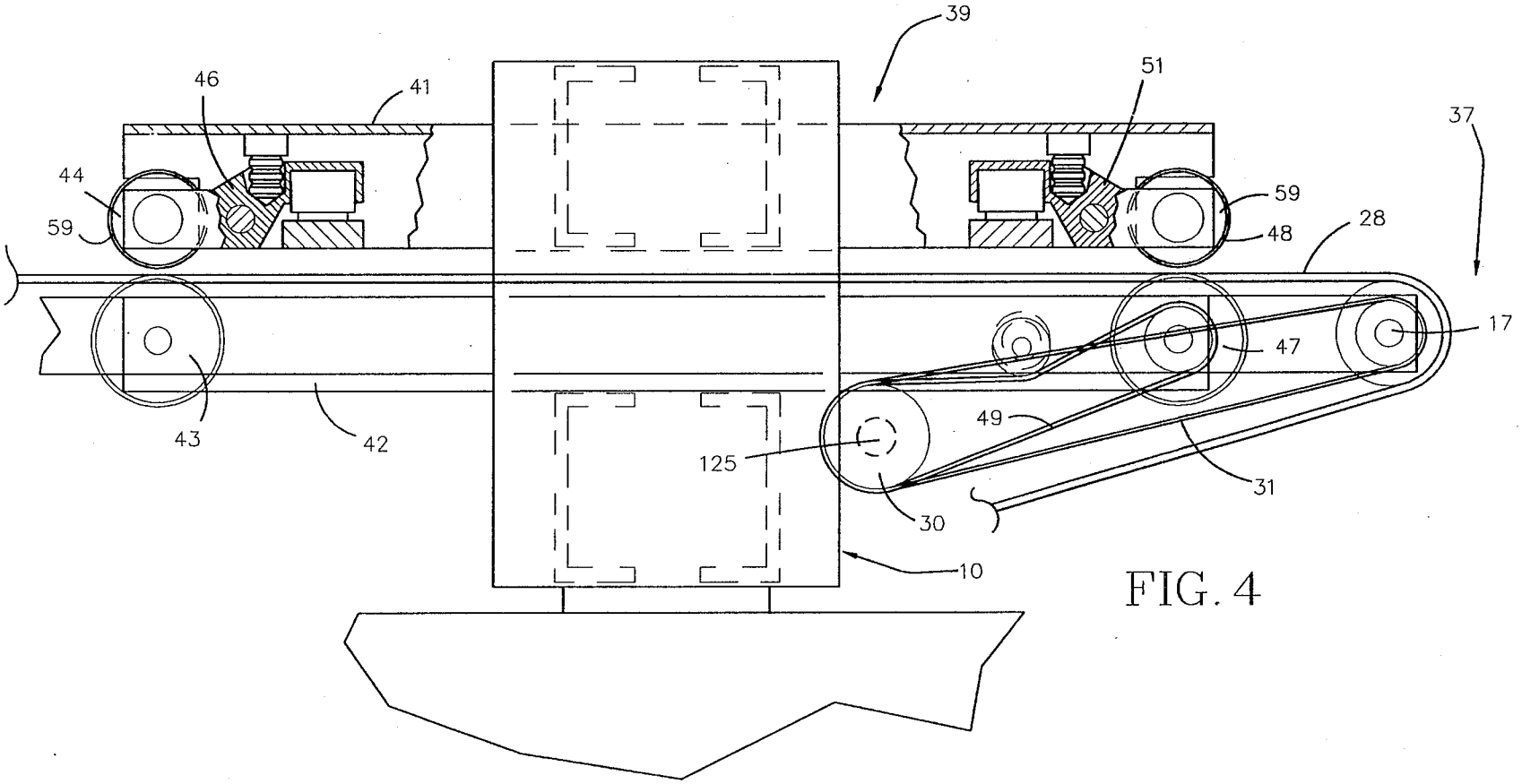
FIG. 4 is an enlarged, fragmentary side elevation of the roller guide and feed mechanism which operates to guide and feed the sheets into the roll former.

Located at the launch position 36 adjacent to the exit end 37 of the machine is a gripper/launcher assembly 39, best illustrated in FIG. 4. The launcher assembly includes upper and lower support beams 41 and 42 carried by the main frame 10 and extending along the longitudinal centerline 38 of the machine above and below the plane of the upper reaches 28 of the belts. Journaled on the lower beam 42 at the end thereof remote from the exit end 37 of the machine is a fixed idler roll 43 which engages the lower surface of a sheet moving along the upper reaches 28 of the belts.

Positioned immediately above the idler roll 43 is a second idler roll 44 journaled on a pivot arm 46. As discussed below, the upper idler roll is vertically movable from a retracted position spaced from a sheet being carried along the upper reaches 28 of the belts and an operative lowered position in which is engages the upper side of such sheet and causes gripping of the sheet between the two idler rolls 43 and 44. The pivot axes of the two rolls 43 and 44 are contained in a plane perpendicular to the longitudinal centerline 38 so that a sheet gripped therebetween is held against lateral movement but is free to move along the longitudinal centerline 38 of the machine.

A similar pair of rolls 47 and 48 is provided at the other end of the beams 41 and 42, substantially adjacent to the exit end 37 of the machine. The lower of such rolls 47 is connected to the drive motor 30 by a belt 49 and operates during launch to drive a sheet along the centerline 38, as discussed below. The upper roll 48, however, is an idler roll and is also mounted on a pivot arm 51 so that it can be raised up clear of a sheet or pressed down against the sheet to cause gripping of the opposite sides of the sheet by the two rolls 47 and 48.

Figure 5:
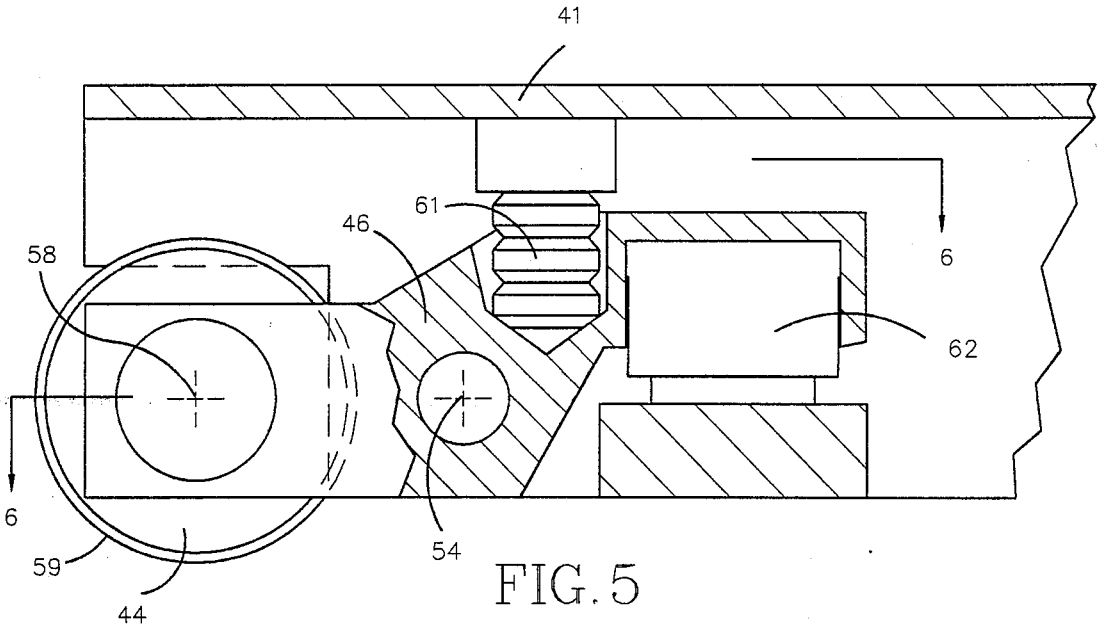
FIG. 5 is a further enlarged, fragmentary view, partially in section, illustrating the structure of one upper roller guide subassembly.
Figure 6:
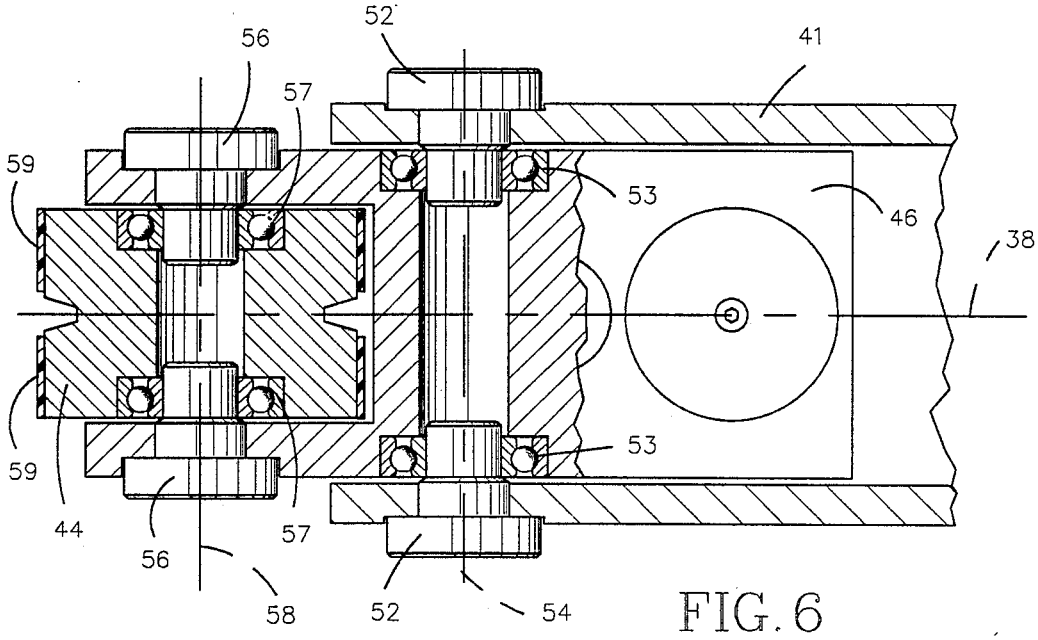
FIG. 6 is an enlarged, fragmentary, broken section taken generally along line 6—6 of FIG. 5.

Reference should now be made to FIGS. 5 and 6, which illustrate the structural detail of the mounting of the two upper rolls 44 and 48. In these figures, the pivot arm 46 and idler roll 44 are illustrated. It should be understood, however, that the pivot arm 51 and the idler roll 48 are structurally identical except for the fact that the pivot arm 51 extends in the opposite direction along the centerline 38. Therefore, the detailed description of the structure of the mounting system of the pivot arm 46 applies equally to the structure and mounting of the pivot arm 51.

The pivot arm 46 is journaled on the beam 41 by opposed pivot elements 52 and associated bearings 53 for oscillating pivotal movement about a pivot axis 54 contained in a plane perpendicular to the longitudinal centerline 38. A similar structure is provided for journaling the idler roll 44 on the pivot arm, which includes opposed pivot elements 56 and bearings 57, so that the roller 44 is free to rotate about a pivot axis 58 parallel to the axis 54 and contained in a plane perpendicular to the longitudinal centerline 38.

As best illustrated in FIG. 6, the idler roll 44 is provided with a pair of elastomeric tires 59 which provide the actual engagement with the surface of the piece of sheet metal. These tires 59 protect the finish of the sheet metal while providing good frictional contact therewith. All of the rolls 43, 44, 47, and 48 have a similar structure, and all are journaled for rotation about pivot axes contained in planes perpendicular to the longitudinal centerline 38.

located on the side of the pivot axis 54 remote from the roll 44 is an elastic compression spring 61 which acts between the beam 41 and the pivot arm and exerts a force on the pivot arm tending to rotate the pivot arm 46 in a clockwise direction. Adjacent to the compression spring 61 is a pressure-operated actuator 62 which acts between the beam 41 and the pivot arm 46, and is operable to exert an upward force on the end of the pivot arm.

When the actuator 59 is not pressurized, the compression spring 61 causes the pivot arm 46 to rotate in a clockwise direction, lifting the idler roll 44 to its retracted position. When the actuator 62 is pressurized, it overcomes the action of the compression spring 61 and lowers the idlers roll 44 into engagement with the surface of the pieces of sheet metal and causes the two idler rolls 43 and 44 to tightly grip the sheet.

A similar situation exists with respect to the two rolls 47 and 48. When the actuator 62 associated with the pivot arm 51 is depressurized, the associated spring 61 lifts the idler roll 48, but when the actuator is pressurized, the two rolls 47 and 48 operate to grip the opposite sides of the piece of sheet metal.

Because the pair of rolls 43 and 44 are substantially spaced from the pair of rolls 47 and 48 along the longitudinal centerline 38 of the machine, and because such rolls, through their frictional engagement with the sheet, prevent lateral movement of the engaged portions of the piece of sheet metal, the rolls operate during their clamping operation to prevent any movement of the piece of sheet metal except along the longitudinal centerline 38.

Figure 3:
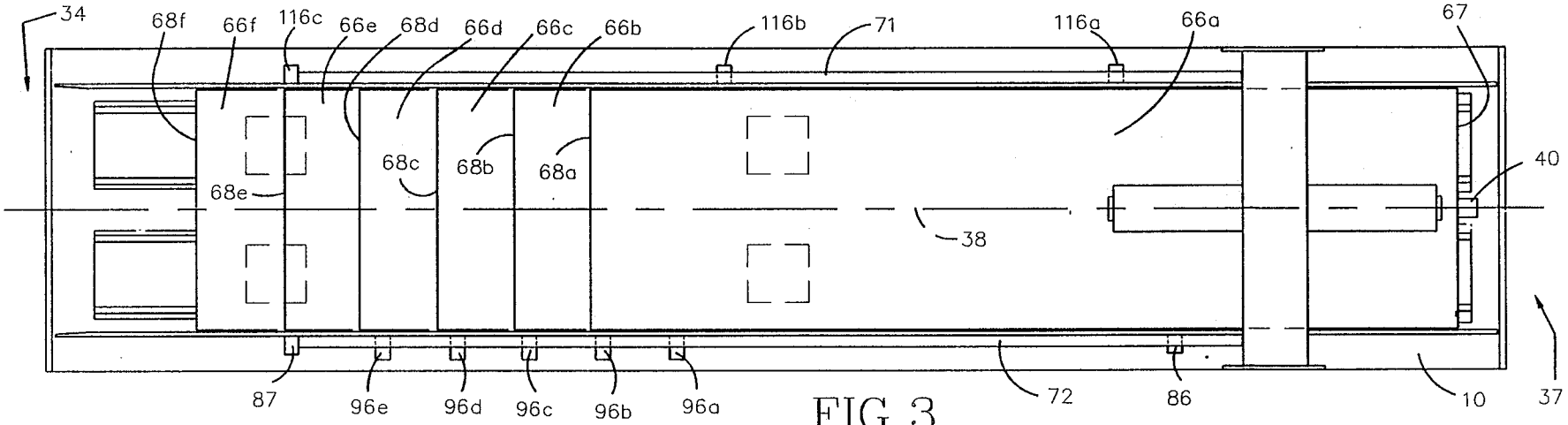
FIG. 3 is a schematic plan view similar to FIG. 1, but illustrating the apparatus with the various sizes of pieces of sheet metal which can be launched and schematically illustrating the pushers which precisely position the sheet at the launch position.

Reference should now be made to FIG. 3, which schematically illustrates the machine with pieces of sheet metal 66 thereon. In this FIG. 3, the versatility of the machine is illustrated in that it is operable to align and launch pieces of sheet metal of various lengths. For example, a relatively short piece of sheet metal **66*a* is illustrated having a length extending from a forward end 67 to a rearward and 68*a*. Such sheet 66*a*** provides an example of a relatively short piece of sheet metal which can be handled.

Also illustrated is a piece of sheet metal **66*b* having a greater length extending from a forward 67 to a rearward end at 68*b*. Also illustrated are four additional sizes of pieces of sheet metal 66*c*, 66*d*, 66*e*, and 66*f*, each having a progressively longer length and respectively extending from a forward end at 67 to rearward ends 68*c*, 68*d*, 68*e*, and 68*f*. This composite illustration of sheets of various sizes illustrates the versatility of the machine; however, it should be understood that multiple sheets are never simultaneously positioned at the launch position 36** at a given time. It is important, however, since appliances of different sizes require pieces of sheet metal of different lengths, to provide a launcher which is capable of handling a variety of sizes of pieces of sheet metal.

Mounted on the frame 10 and extending lengthwise thereof on opposite sides of the frame are pusher rails 71 and 72. These rails are laterally movable between a retracted position clear of the longitudinal edges of the pieces of sheet metal 66 and an operative position in which they bring pusher elements into engagement with the longitudinal edges of the sheet to precisely center the sheets in the launcher.

Figure 7:
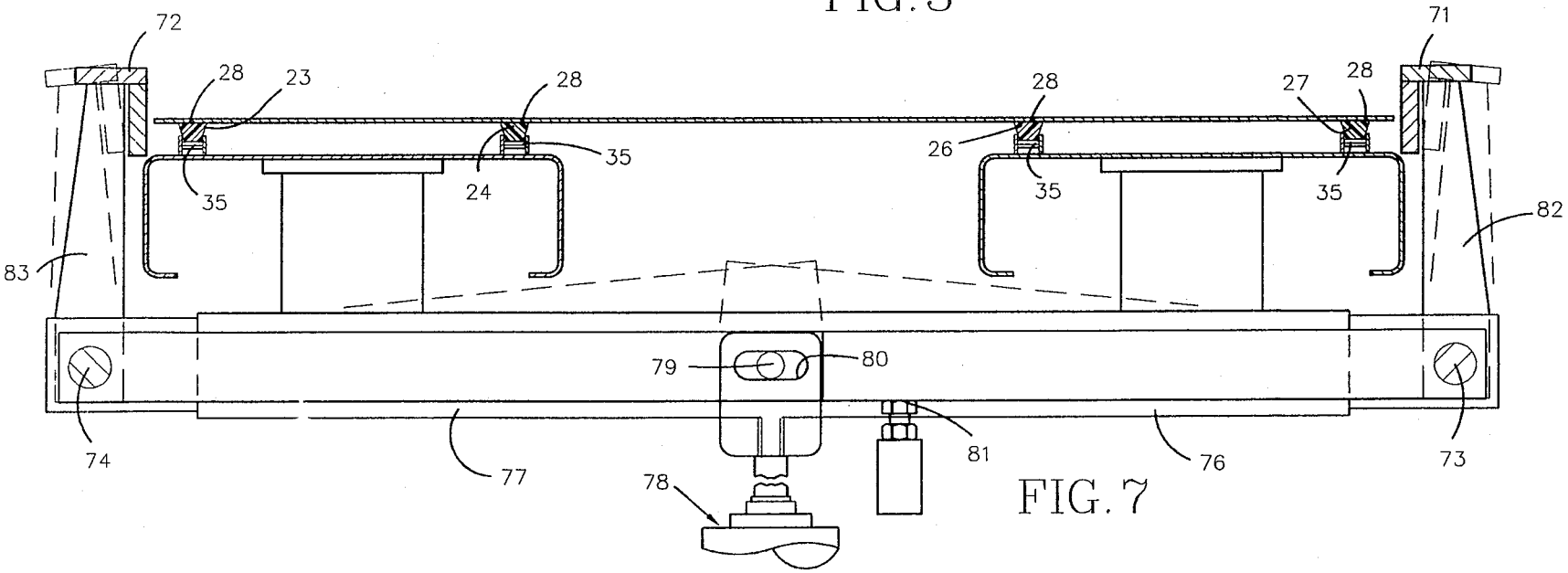
FIG. 7 is an enlarged end view, illustrating the support and operating system for the pushers which center and align the sheets prior to launching.

FIG. 7 illustrates the support and operating system for the rails 71 and 72. Mounted on the frame 10 and extending lengthwise along the machine on the opposite sides thereof are two shafts 73 and 74. Each of these shafts is mounted for oscillating pivotal movement about its longitudinal axis. A first lever 76 is mounted on the shaft 73 and locked against rotation relative thereto. The lever 76 extends inwardly toward the center of the machine and overlaps a second lever 77 which is mounted on the shaft 74.

Located at the center of the machine is a piston-and-cylinder actuator 78 which provides a vertically movable, horizontally extending cross pin 79. This cross pin extends through a slot 80 formed in each of the levers 76 and 77. When the actuator 78 is extended from the full-line position illustrated in FIG. 7 to raise the cross pin 79, the lever 76 rotates in a clockwise direction and the lever 77 rotates in an anticlockwise direction to the phantom-line positions. Conversely, when the actuator 78 is retracted to the full-line position from the extended position, the two levers move in the opposite direction. An adjustable stop 81 is positioned for engagement with the lever 76 to limit the rotation of such lever in an anticlockwise direction to the full-line position illustrated. The stop 81 also limits the rotation of the lever 77 in the clockwise direction to the illustrated position by virtue of the interconnection between the two levers provided by the cross pin 79.

A plurality of upstanding support arms 82 are mounted on the shaft 73 at longitudinally spaced locations along the length of the machine and support the rails 71 at their upper ends. Consequently, when the lever 76 is rotated in a clockwise direction by the extension of the actuator 78, the arms 82 also rotate in a clockwise direction through the same angle and move the rail 71 from its inward operative position illustrated in full-line to a phantom position, in which it is spaced a greater distance from the centerline of the machine.

Similarly, a plurality of upstanding support arms 83 are mounted on the shaft 74 at longitudinally spaced locations and support the rails 72 at their upper end. Here again, the extension of the actuator 78 causes pivotal movement of the lever 77 and the support arms 83 to move the rail 72 outwardly from the full-line operative position to the phantom-line retracted position.

Figure 8:
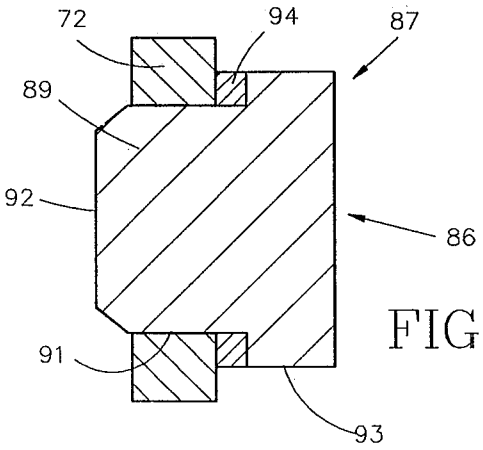
FIG. 8 is an enlarged, fragmentary cross section of one of the fixed pushers.

Referring again to FIG. 3, two fixed pushers 86 and 87 are mounted on the rails 72, with the pusher 86 located near the exit end 37 of the machine and the pusher 87 location near the entrance end 34 of the machine. These pushers 86 and 87 have a structure, best illustrated in FIG. 8, which includes a hardened block 89 having a cylindrical portion 91 extending through the associated rail 27 to an end face 92. The rearward end of the pusher is provided with a head portion 93. A spacer 94 is positioned between the head portion 93 and the rearward side of the rail to determine the position of the forward face 92 with respect to the rail. The size of the spacer 94 is selected to accurately establish the position of the spacer 92 with respect to the rail 72 for the reasons discussed in greater detail below.

Figure 9:
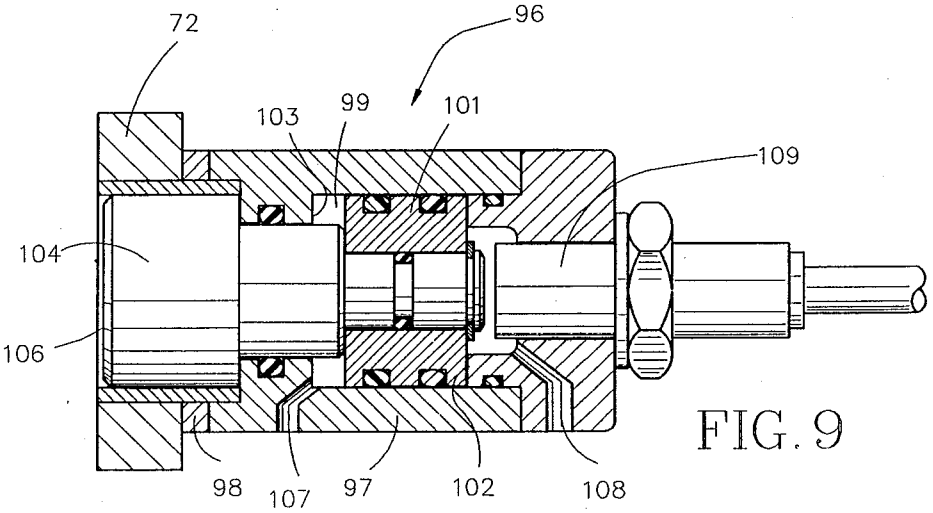
FIG. 9 is an enlarged, fragmentary cross section of one of the retractable pushers.

Also mounted on the rail 72 at spaced locations indicated in FIG. 3 are a plurality of retractable pushers 96 having a structure best illustrated in FIG. 9. In the illustrated embodiment, there are five identical retactable pushers **96*a* through 96*e* spaced at intervals along the length of the rail 72**.

Referring to FIG. 9, each pusher is provided with a body assembly 97 mounted on the rail 72 and spaced therefrom by a spacer 98. The body assembly defines a pressure chamber 99 in which a piston assembly 101 is movable between shoulders 102 and 103. The piston assembly also includes a hardened pusher 104 having a forward face 106.

When fluid under pressure is supplied to a first port 107, the piston assembly moves to the full-line retracted position and the face 106 is recessed slightly from the forward face of the rail 72. However, when fluid under pressure is supplied to a port 108, the piston assembly extends and the forward face 106 is moved to an extended position in which it is operable to engage the edge of a piece of sheet metal. A proximity sensor 109 is mounted to provide a signal to the control system of the machine for indicating whether or not the piston assembly 101 is extended or retracted.

Figure 10:
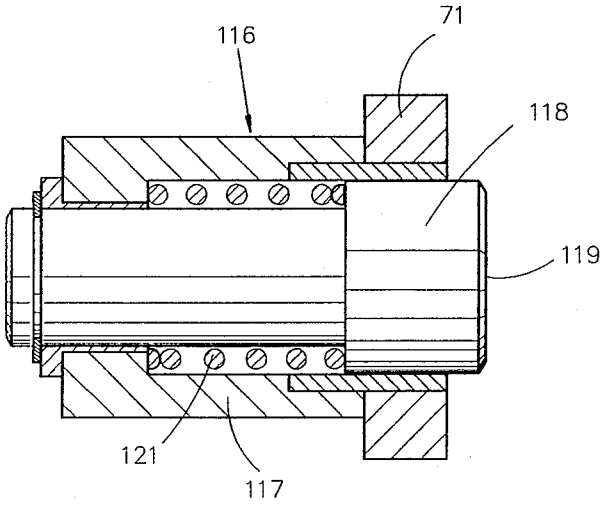
FIG. 10 is an enlarged, fragmentary cross section of one of the resilient pushers.

In the illustrated embodiment, three resilient pushers **116*a*, 116*b*, and 116*c* are mounted at spaced locations along the rail 71, as illustrated in FIG. 3. Each of these resilient pushers 116 has a structure best illustrated in FIG. 10 and includes a cylindrical body 117 mounted on the rail 71. Slidably mounted in the body is a hardened pusher element 118 having an end face 119 engageable with one side edge of a sheet of sheet metal. A spring 121 normally maintains the pusher element 118 in an extended position in which the end face 119 extends beyond the rail 71. However, upon engagement of the edge of a piece of sheet metal by the end face 119 with sufficient force, the spring 121 allows the pusher element 118** to retract from the extended full-line position.

The overall operation of the machine is as follows. Assuming first that the piece of sheet metal, which must be positioned and launched into the roll former, has a length of the sheet 66*f*. The motor 30 powering the launcher rotates the cross shaft 17, causing the upper reaches of the belts, 23, 24, 26, and 27 to move to the right, as viewed in the drawings, from the entrance end 34 to the exit end 37. The sheet 66*f* enters the machine from the entrance end and is carried by the belts along the length of the machine until the end of the sheet reaches the location at 67 and engages an extended stop 40. When the stop 40 is engaged, the motor is also stopped so that the belts remain stationery. While the sheet is feeding into the machine to the stop 40, the actuator 78 is extended, causing the rails to move laterally clear of the sheet to allow it to pass along the length of the machine. Also, the launcher rolls 44 and 48 are raised clear of the sheet.

While the belts are stopped, the actuator 78 is retracted, causing the opposed rails 71 and 72 to be moved forward to the operative position. When feeding a long sheet having a length of the sheet 66*f*, all of the retractable pushers are retracted and do not engage the adjacent lateral edge of the sheet when the rails are moved inwardly. Instead, the fixed pushers 86 and 87 engage the adjacent edge of the piece of sheet metal 68*f* near its ends and, in the event that the piece is off-center in a direction toward the fixed pushers 86 and 87, they engage the sheet and move it laterally to a predetermined position established by the end faces 92 of the fixed pushers.

As the same time, the resilient pushers 116*a*, 116*b*, and 116*c* engage the opposite lateral edge to ensure that the sheet is positioned against the fixed stops 86 and 87. If the sheet is initially located out of position on the side toward the resilient stops, they also function to move the sheet laterally until the sheet engages the fixed stops 86 and 87. Because the resilient stops are spring-biased toward the forward position, they operate to move the sheet into engagement with the fixed stops to a predetermined position determined by the fixed stops regardless of the variations in the width of the sheet within manufacturing tolerances.

The fixed stops locate the adjacent edge of the sheet in a predetermined position. Further, since they engage the sheet at a location substantially adjacent to the forward and rearward ends, the alignment of the sheet with the central, longitudinal centerline of the sheet 38 is accurately determined even if the edge of the sheet adjacent to the fixed stop is not completely straight.

While the sheet is in the center position determined by the fixed stops 86 and 87 and in exact alignment with the centerline of the machine, automatic inspection of the sheet is preferably performed. For example, if the sheet requires prepunched holes, openings, or other types of cutouts, it is important to determine before the rolling operation that the prepunched cutouts have been properly made in the sheet at the proper locations. For this purpose, photoelectric sensors 120 are located along the frame of the machine where each cutout should exist and provide a signal indicating the presence or absence of a proper cutout at a proper locations. In the drawing, only three sensors 120 are illustrated, but it should be understood that one or more sensors is provided at each cutout position.

While the sheet is being moved into the launch position, the idler rolls 44 and 48 of the laucher are retracted so that the sheet is freely movable into the launch position and is freely movable laterally into the aligned and centered position. While the rails are retained in the operative position to hold the sheet in its centered and aligned position, the rolls 44 and 48 of the launcher are lowered, causing the sheet to gripped at two spaced locations between the pairs of rolls. After gripping by the rolls, the actuator 78 is extended to retract the rails and move the various pushers back from the lateral edges of the sheet.

After the rails 71 and 72 have been retracted by the extension of the actuator 78, the motor 30 is again started, causing the powered lower roll 47 and the belts to again move the sheet forward past the exit end 37 of the machine into the roll former. The belt drives are arranged to power the belts and the roll 47 at the same surface speed so they cooperate in feeding the sheet.

Because the two pairs of rolls engage the surface of the sheet with gripping engagement at longitudinally spaced locations therealong, the sheet is held in the centered position and maintained in exact alignment as it passes from the launcher into the roll former. Preferably, the drive motor is operated at a speed that moves the sheet at a speed less than the speed the sheet is carried through the roll former. Therefore, as the sheet enters the roll former 29, its speed is increased. An overriding clutch 125 is provided in the drive of the motor 30, permitting the belts and roller 47 to speed up when the speed of the sheet is increased by the roll former.

The gripping engagement by the pairs of rolls is maintained even after the forward end of the sheet enters the roll former to ensure that the entire sheet remains centered and aligned even after the initial gripping of the sheet by the roll former. In fact, it is preferably to maintain the gripping engagement between the rollers 47 and 48 until the rearward edge of the sheet passes from the launcher into the roll former. Therefore, the guiding action of the laucher is maintained until substantially the entire sheet has moved into the roll former and run-out of the rearward end of the sheet is prevented.

In the event that the pieces of sheet metal being fed into the roll former have shorter lengths, such as the sheets 66*a* through 66*d*, the rearward ends of the sheet are forward of the fixed stop 87 when the forward end of the sheet engages the retractable stop 40. In such instances, the controls for the machine are operated to extend one of the extendible pushers 96*a* through 96*e* before the actuator 78 moves the rails in to center the sheet. For example, if the sheet has a length of the sheet 66*d*, the extendible pusher 96*e* is extended by pressure supplied to the port 108. When extended, the pusher 96*e* is in exact alignment with the fixed stop 86 and functions like the fixed stop 87 to accurately position the adjacent longitudinal edge of the sheet. In such case, the two resilient pushers 116*a* and 116*b* ensure that the piece of sheet metal 66*d* is properly positioned against the extended stop 96*e* and the fixed stop 86 so that the sheet being fed is accurately positioned both as to lateral position and alignment. During such operation, the extendible pushers 96*a* through 96*d* are not extended and do not function.

Similarly, if the sheet has a length of the sheet 66c, the extendible pusher 96d is extended prior to the centering operation and cooperates with the fixed stop 86 to accurately position the sheet. In the case of sheets of even less length, the appropriate extendible stop is extended and engages the shorter sheets substantially adjacent to the rearward end thereof and ensures proper centering and alignment prior to the actual launching operation.

Preferably, sensors such as the proximity sensor 109 are provided to produce a signal establishing the position of the rails and other operating components. These signals from the various components of the machine are supplied to a computer which automatically controls the operation of the machine to ensure that each of the operational sequences occurs in a proper manner.

With this invention, a relatively simple launching system ensures exact lateral and alignment positioning of each sheet before it is launched into the roll former, and ensures that such alignment and lateral positioning are maintained until the individual sheets have moved a substantial distance into the roll former.

In should be understood that although the present invention is particularly suited for properly feeding elongated pieces of sheet metal into a roll former, the invention in its broader aspects can be used to launch sheet metal or the like into other processing equipment. Becasue the launcher is automated, the labor cost in the launching of the sheets is eliminated, and because the launching is accomplished accurately, the problems of side drift or run-out out are virtually nonexistent. Further, since the surface of the rollers which actually grips the sheet in the launching operation is an elastomeric material which provides good friction without damaging the contacted surface, the launcher is operable to launch prepainted or prefinished sheet metal without damaging the surface thereof.

Although the preferred embodiment of this invention has been shown and described, it should be understood that various modifications and rearrangements of the parts may be restored to without departing from the scope of the invention as disclosed and claimed herein.

What is claimed is:

1. A sheet launcher, for feeding elongated pieces of sheet material to processing equipment, comprising first transfer means for transporting individual elongated, substantially rectangular pieces of sheet material to a launch position, centering means operating to laterally move said sheets at said launch position to locate said sheets at a centered location in said launch position in which said sheets are laterally and longitudinally aligned with respect to said processing equipment, and guide means operating to grip and guide said sheets at longitudinally spaced locations as said sheets move to said processing equipment, said guide means operating to maintain gripping engagement with said sheets and operating to guide said sheets into said processing equipment until a substantial portion thereof enters said processing equipment, said centering means including first pushers along one side of said sheets which are located in a fixed position for positioning the adjacent edge of said sheets in a predetermined lateral location, said centering means also including second pushers along the opposite edge of said sheets which resiliently engage said sheets and maintain said sheets against said first pushers.

2. A sheet launcher as set forth in claim 1, wherein said first pushers engage said sheets at locations substantially adjacent to the ends thereof.

3. A sheet launcher as set forth in claim 2, wherein said first pushers include retractable pushers selectively extendible to said fixed position to engage and center sheets of different lengths.

4. A sheet launchers as set forth in claim 3, wherein said guide means includes longitudinally spaced pairs of rollers operable to engage and grip opposite sides of said sheets to maintain said sheets centered and aligned with respect to processing equipment as said sheets enter said processing equipment.

5. A sheet launcher as set forth in claim 4, wherein said rollers are provided with elastomeric tires and at least one of said rollers of one of said pairs of rollers is powered to feed said sheets into said processing equipment.

6. A sheet launcher as set forth in claim 5, wherein said processing equipment is a roll former which moves said sheets faster than said one roller, and said one roller is driven through an overriding clutch permitting said sheets to move with increased speed without slippage between said sheets and said one roller.

7. A sheet launcher as set forth in claim 6, wherein said sheets are precut with cutouts, and said launcher includes sensors located to determine that a sheet in said launch position contains proper cutouts.

8. A launcher for launching rectangular sheets of sheet metal into roll formers and the like, comprising an elongated frame extending from an entrance and to an exit end, a power conveyor on said frame operable to receive said sheets at said entrance end and transport them to a launch position, pushers long opposite sides of said conveyor operable to engage longitudinal edges of said sheets in said launch position and move said sheets laterally to center and align said sheets in a predetermined position, and launching means operable to grip said centered and aligned sheets at longitudinally spaced locations and feed said sheets into said roll former and the like while maintaining said sheets aligned and centered with respect thereto, said launcher operating to grip and guide said sheets until a substantial portion thereof enters such roll former and the like, said launcher means including longitudinally spaced pairs of rolls operable to grip sheets therebetween, said pushers including selectively operable pushers at spaced locations along said frame selectively operable to engage sheets of various lengths substantially adjacent to the rearward end thereof, and said conveyor including a plurality of spaced and parallel belts operator to support said sheets at laterally spaced zones.

9. A method of launching sheets of substantially rectangular sheet metal having dimensional variations resulting from manufacturing tolerances and cut-outs into processing equipment comprising positioning said sheets in a launch position, moving said sheets laterally until one side thereof is located in a predetermined position of lateral and longitudinal alignment with said processing equipment and the opposite side of said sheet is in a position which varies with the dimensional variations of said sheets, inspecting said sheets for proper cut-out locations while said sheets are in said launch position, gripping said sheets at longitudinally spaced locations to maintain said sheets in alignment with said processing equipment, and while maintaining said gripping feeding a substantial portion of said sheets into said processing equipment.

* * * * *

UNITED STATES PATENT AND TRADEMARK OFFICE

CERTIFICATE OF CORRECTION

PATENT NO. : 4,917,370

DATED : April 17, 1990

INVENTOR(S) : Graham W. Batts

It is certified that error appears in the above-identified patent and that said Letters Patent is hereby corrected as shown below:

Column 1, line 45, after "example" delete ",".

Column 1, line 50, delete "4,472,854" and insert --4,472,864--.

Column 2, line 35, delete "results" and insert --result--.

Column 4, line 62, delete "idlers" and insert --idler--.

Column 5, line 19, delete "and" and insert --end--.

Column 6, line 26, delete "location" and insert --located--.

Column 7, line 39, delete "As" and insert --At--.

Column 8, line 1, delete "locations" and insert --location--.

Column 8, line 6, delete "laucher" and insert --launcher--.

UNITED STATES PATENT AND TRADEMARK OFFICE

CERTIFICATE OF CORRECTION

PATENT NO. : 4,917,370

DATED : April 17, 1990

INVENTOR(S) : Graham W. Batts

It is certified that error appears in the above-identified patent and that said Letters Patent is hereby corrected as shown below:

Column 8, line 12, after "to" insert --be--.

Column 8, line 41, delete "preferably" and insert --preferable--.

Column 8, line 45, delete "laucher" and insert --launcher--.

Column 9, line 23, delete "In" and insert --It--.

Column 9, line 28, delete "Becasue" and insert --Because--.

Column 10, line 8, delete "launchers" and insert --launcher--.

Signed and Sealed this

Thirteenth Day of August, 1991

*Attest:*

HARRY F. MANBECK, JR.

*Attesting Officer*

*Commissioner of Patents and Trademarks*